US010478026B1

(12) United States Patent
Nemetz, Jr.

(10) Patent No.: US 10,478,026 B1
(45) Date of Patent: Nov. 19, 2019

(54) TOILET SPLASH GUARD APPARATUS WITH ENHANCED SANITATION

(71) Applicant: John Michael Nemetz, Jr., West Ccovina, CA (US)

(72) Inventor: John Michael Nemetz, Jr., West Ccovina, CA (US)

( * ) Notice: Subject to any disclaimer, the term of this patent is extended or adjusted under 35 U.S.C. 154(b) by 0 days.

(21) Appl. No.: 16/031,667

(22) Filed: Jul. 10, 2018

Related U.S. Application Data

(60) Provisional application No. 62/531,150, filed on Jul. 11, 2017.

(51) Int. Cl.
*A47K 11/10* (2006.01)

(52) U.S. Cl.
CPC ..... *A47K 11/105* (2013.01)

(58) Field of Classification Search
CPC ..... A47K 17/00; A47K 13/14–225; A61B 10/0038; E03D 9/00; E03C 1/181
See application file for complete search history.

(56) References Cited

U.S. PATENT DOCUMENTS 4,010,497 A 3/1977 Menter
4,014,341 A * 3/1977 Karami ..... A61F 13/15634 428/131
4,286,002 A * 8/1981 Strong ..... A47K 11/12 604/375
4,705,050 A * 11/1987 Markham ..... A61B 10/0038 4/300.3
5,611,092 A 3/1997 Van Dusen
6,081,937 A * 7/2000 Whitacre ..... E03D 9/00 4/300.3
6,170,092 B1 * 1/2001 May ..... A47K 13/24 4/300.3
6,374,428 B1 * 4/2002 Copeland ..... A47K 17/00 4/300.3
6,564,399 B1 5/2003 Teal
7,398,565 B1 * 7/2008 Chou ..... E03D 13/005 4/300.3
2004/0093663 A1 * 5/2004 Zhu ..... A47K 17/00 4/300.3
2006/0260497 A1 * 11/2006 Neale ..... A47K 11/105 101/494
2007/0039089 A1 * 2/2007 Worrel ..... E03D 9/00 4/300.3

(Continued)

*Primary Examiner* — Erin Deery
*Assistant Examiner* — Nicholas A Ros
(74) *Attorney, Agent, or Firm* — Plager Schack LLP; Mark H. Plager; Eric Liou

(57) ABSTRACT

A splash guard apparatus for use in a bowl of a toilet to enhance sanitation is provided. The splash guard apparatus includes a sheet assembly disposed on the water in the bowl of the toilet. The sheet assembly includes an upper sheet and a lower sheet coupled together, the upper sheet having a plurality of slits disposed therethrough, the lower sheet coupled to the bottom surface of the upper sheet and in contact with the water in the bowl of the toilet. The plurality of slits in the upper sheet of the sheet assembly deflect any fluid waste disposed thereon within the bowl of the toilet to minimize the contaminated water in the bowl from exiting the toilet. The sheet assembly in the bowl encapsulates the solid waste disposed on the upper sheet, thereby minimizing splashes of the contaminated water from exiting the bowl of the toilet.

3 Claims, 3 Drawing Sheets

(56) References Cited

U.S. PATENT DOCUMENTS

| | | | | |
|---|---|---|---|---|
| 2009/0113613 | A1 | 5/2009 | Kole | |
| 2011/0067171 | A1* | 3/2011 | Kouadio | A47K 13/14 4/245.1 |
| 2012/0324639 | A1* | 12/2012 | Field | A47K 11/105 4/224 |
| 2017/0058501 | A1 | 3/2017 | Painter | |

* cited by examiner

TOILET SPLASH GUARD APPARATUS WITH ENHANCED SANITATION

RELATED APPLICATION

The application claims priority to provisional patent application U.S. Ser. No. 62/531,150 filed on Jul. 11, 2017, the entire contents of which is herein incorporated by reference.

BACKGROUND

The embodiments herein relate generally to liners or guards for use in toilets. More specifically, embodiments of the invention are directed to a toilet splash guard apparatus with enhanced sanitation.

When using the toilet, the contaminated water can splash from the bowl onto the floor, the bottom of the toilet seat, the porcelain rim of the toilet and the person using the toilet. As a result, there is a need to create a more sanitary area around the toilet, including the surrounding floor area and the underneath of the seat of the toilet.

Several liners and splash guards for toilets exist as disclosed in U.S. Pat. Nos. 5,611,092, 6,564,399 and 4,010,497, and U.S. Patent Application Publications 2017/0058501 and 2009/0113613, which are disposed into the bowl of the toilet. However, these liners and splash guards are limited for one or more of the following limitations: (1) the item does not effectively minimize the splashing of contaminated water caused by depositing fluid and solid wastes into the toilet bowl; (2) the design of the liner or guard does not enhance flotation of the item within the toilet bowl to improve effectiveness of the device; and (3) the item is not designed for use with toilets with variable sizes and different target users including adults and children.

As such, there is a need in the industry for a toilet splash guard apparatus that overcomes the limitations of the prior art, which provides an effective solution to minimize the splash effects of using the toilet where both liquid and solid wastes are deposited into the bowl. There is a further need for the toilet splash guard apparatus to be effective for both standing and sitting uses of the toilet. There is a further need for the toilet splash guard apparatus to prevent contaminated water in the toilet bowl from coming in contact with the user, the bottom of the toilet seat, other parts of the toilet and/or the floor area surrounding the toilet.

SUMMARY

A splash guard apparatus for use in a bowl of a toilet to enhance sanitation is provided. The splash guard apparatus is disposed on water in the bowl of the toilet and configured to encapsulate solid waste and deflect fluid waste to minimize the transfer of contaminated water from exiting the bowl of the toilet. The splash guard apparatus comprises a sheet assembly disposed on the water in the bowl of the toilet, the sheet assembly comprising an upper sheet and a lower sheet coupled together and configured to float on the water in the bowl, the upper sheet comprising a top surface, a bottom surface opposite the top surface and a plurality of slits disposed therethrough, the lower sheet coupled to the bottom surface of the upper sheet and in contact with the water in the bowl of the toilet, the lower sheet extending directly beneath the plurality of slits in the upper sheet, wherein the plurality of slits in the upper sheet of the sheet assembly is configured to deflect any fluid waste disposed thereon within the bowl of the toilet to minimize the contaminated water in the bowl from exiting the toilet, wherein the sheet assembly in the bowl is configured to encapsulate the solid waste disposed on the upper sheet, thereby minimizing splashes of the contaminated water from exiting the bowl of the toilet.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
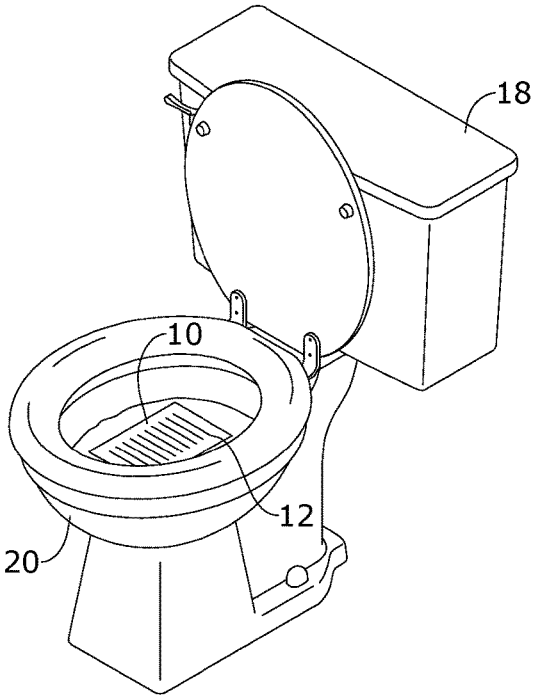
FIG. 1 depicts a perspective view of certain embodiments of the splash guard apparatus shown in use.
Figure 2:
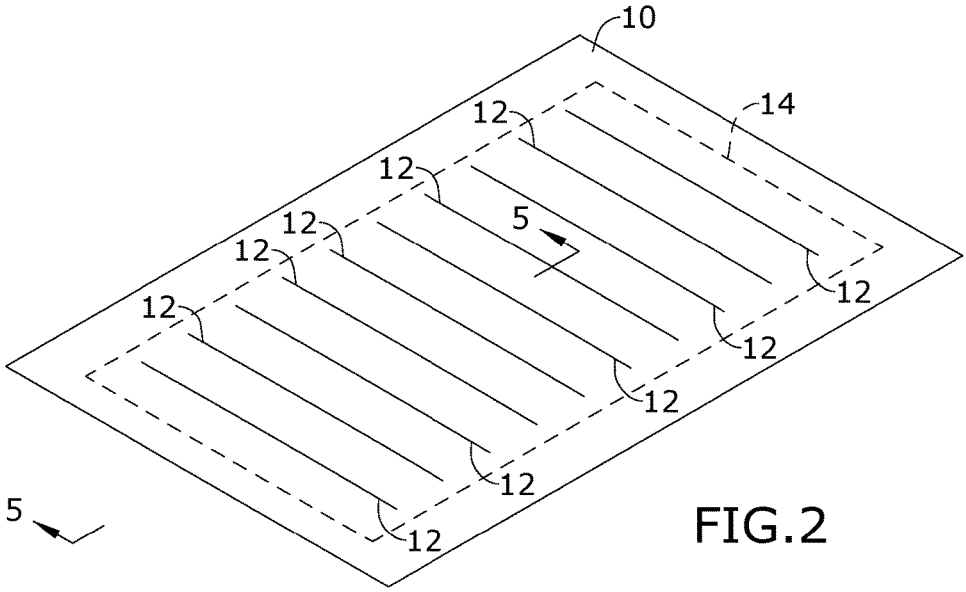
FIG. 2 depicts a perspective view of certain embodiments of the splash guard apparatus.
Figure 3:
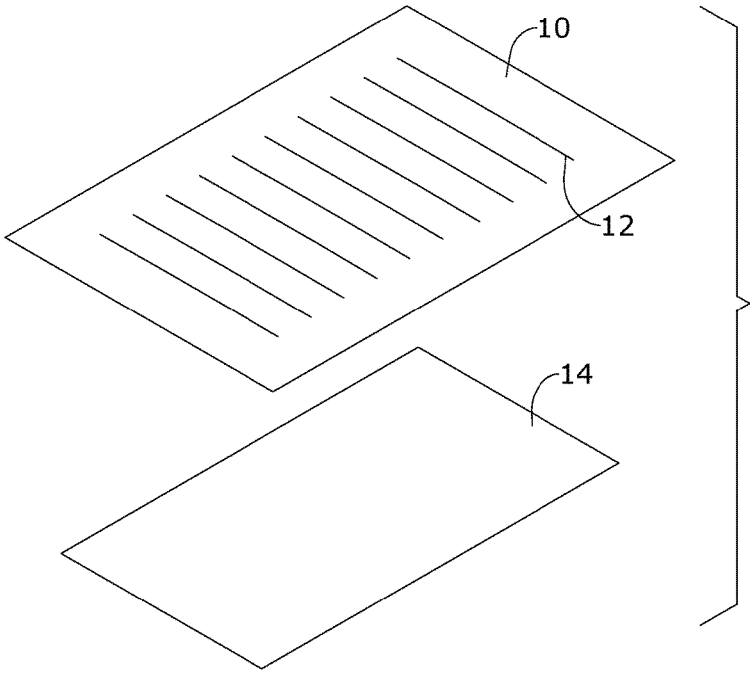
FIG. 3 depicts a top exploded view of certain embodiments of the splash guard apparatus.

As depicted in FIGS. 1-2, the splash guard apparatus is configured to minimize the splashing of contaminated water in bowl 20 of toilet 18 after fluid and solid wastes are deposited therein. More specifically, the splash guard apparatus is disposed on the water in bowl 20 of toilet 18 and is configured to prevent contaminated water from the toilet bowl from coming in contact with the user, the bottom of the toilet seat, other parts of the toilet and/or the floor area surrounding the toilet.

In certain embodiments of the invention, the splash guard apparatus generally comprises a sheet assembly comprising upper sheet 10 coupled to lower sheet 14. As depicted in FIGS. 2-6, upper sheet 10 comprises a rectangular sheet made from paper pulp with approximate dimensions of 9"×6". In one embodiment, the paper pulp is made from recycled and biodegradable materials.

In a preferred embodiment, a plurality of slits 12 are disposed through upper sheet 10 and oriented generally parallel to each other. In one embodiment, each slit 12 is approximately 4" long and spaced approximately 1" from each adjacent slit 12. In one embodiment, each slit 12 is spaced approximately ⅝" from each adjacent slit 12. It shall be appreciated that the number of slits 12 present on upper sheet 10 may vary, as well as the size of slits 12 and spacing between adjacent slits 12.

Figure 4:
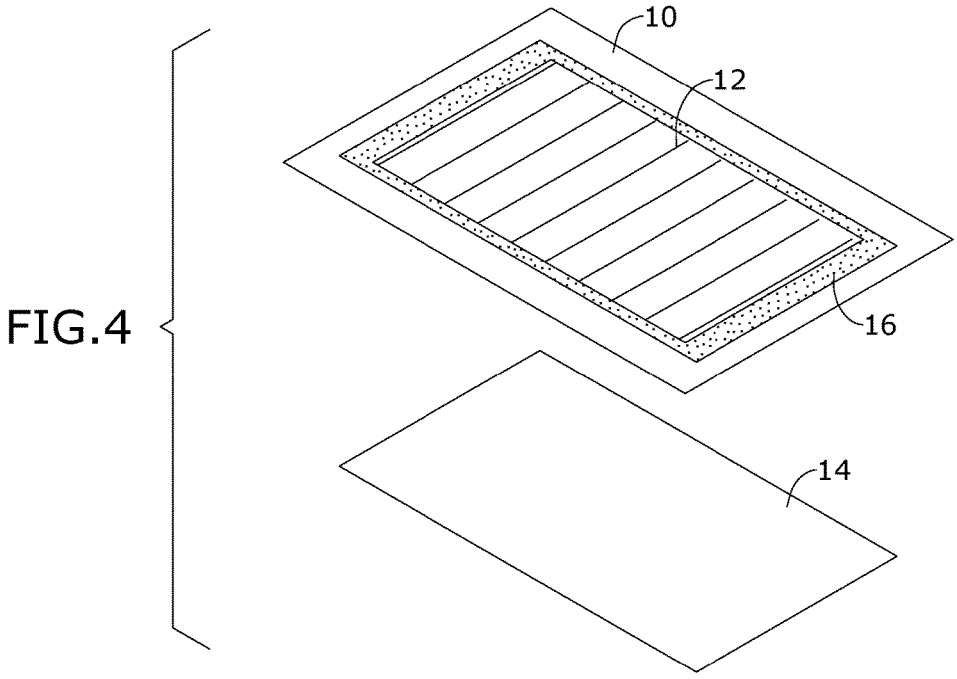
FIG. 4 depicts a bottom exploded view of certain embodiments of the splash guard apparatus.
Figure 5:
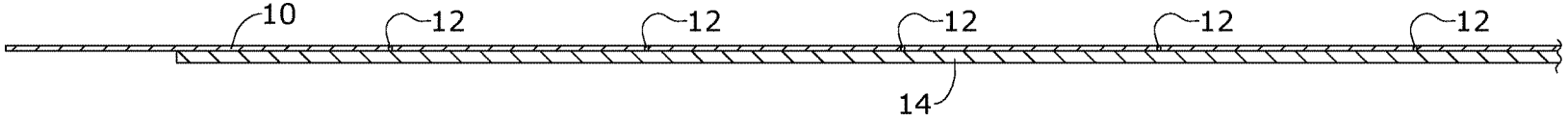
FIG. 5 depicts a section view of certain embodiments of the splash guard apparatus taken along line 5-5 in FIG. 2.
Figure 6:
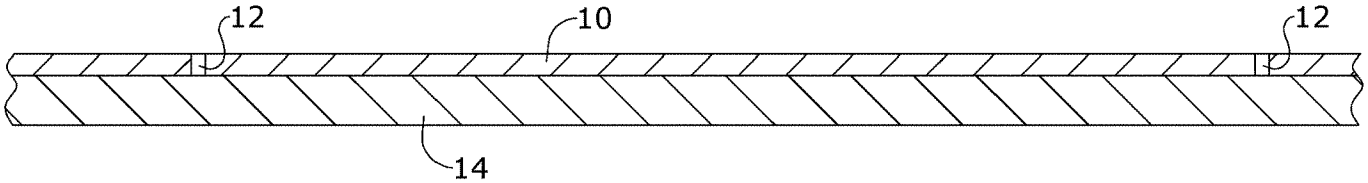
FIG. 6 depicts a section view of certain embodiments of the splash guard apparatus.

Lower sheet 14 is coupled to the bottom surface of upper sheet 10 by adhesive 16. Adhesive 16 may be any type of glue known in the field. In one embodiment, adhesive 16 is disposed on the bottom surface of upper sheet 10 on portions extending along the perimeter of the plurality of slits 12 in upper sheet 10 as depicted in FIG. 4. In one embodiment, adhesive 16 extends up to approximately ¼" away from a first pair of opposing sides on the perimeter of slits 12 and extends up to approximately ⅝" away from a second pair of opposing sides on the perimeter of slits 12.

In one embodiment, lower sheet 14 is a rectangular two-ply sheet made from paper pulp with approximate dimensions of 8"×4½". Lower sheet 14 is positioned to extend directly beneath the plurality of slits 12 in upper sheet 10. Since the top surface area of upper sheet 10 is greater than the top surface area of lower sheet 14, upper sheet 10 extends beyond the outer perimeter of lower sheet 14.

Although the shape of the splash guard apparatus is rectangular as described in embodiments of the invention, it shall be appreciated that the sheet assembly may comprise alternative shapes so long as the apparatus extends along the majority of the top surface of the water in bowl 20 of toilet 18. It shall be appreciated that the sheet assembly of the splash guard apparatus may comprise any alternative number of layers/sheets coupled together and be made of any combination of materials including, but not limited to, various types of paper pulp and wood.

In operation, the splash guard apparatus is a disposable and flushable member disposed on the water in bowl 20 of toilet 18. As depicted in FIG. 1, the splash guard apparatus floats with lower sheet 14 entirely in contact with the water in bowl 20. The splash guard apparatus accommodates users of toilet 20 in both the standing and sitting positions. Fluid waste disposed on slits 12 of upper sheet 10 are deflected and contained within bowl 20 of toilet 18. During this time, fluid waste passes through slits 12 and generates bubbles that are trapped between upper and lower sheets 10, 12. These bubbles enhance flotation of the sheet assembly in bowl 20 while additional waste is deposited on the splash guard apparatus. Solid waste disposed on the splash guard apparatus is encapsulated by the sheet assembly, thereby minimizing any splashing of contaminated water in bowl 20. The encapsulation of solid waste inside the sheet assembly also permits the splash guard apparatus to prevent the soiling of the bottom of bowl 20 in toilet 18. After use, the splash guard apparatus is flushed down toilet 18 in the drainage.

The splash guard apparatus is advantageous because it minimizes the splash effects of using the toilet caused by both liquid and solid wastes deposited into bowl 20 of toilet 18. Further, the splash guard apparatus effectively prevents contaminated water from the toilet bowl from coming in contact with the user, the bottom of the toilet seat, other parts of the toilet and/or the floor area surrounding the toilet.

It shall be appreciated that the components of the splash guard apparatus described in several embodiments herein may comprise any alternative known materials in the field and be of any color, size and/or dimensions. It shall be appreciated that the components of the splash guard apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A splash guard apparatus for use in a bowl of a toilet to enhance sanitation, the splash guard apparatus disposed on water in the bowl of the toilet and configured to encapsulate solid waste and deflect fluid waste to minimize the transfer of contaminated water from exiting the bowl of the toilet, the splash guard apparatus comprising:

a sheet assembly disposed on the water in the bowl of the toilet, the sheet assembly comprising an upper sheet and a lower sheet coupled together and configured to float on the water in the bowl, the upper sheet comprising a top surface, a bottom surface opposite the top surface and a plurality of slits disposed therethrough, the plurality of slits in the upper sheet of the sheet assembly being oriented parallel to each other, the lower sheet comprising a two-ply sheet coupled to the bottom surface of the upper sheet and in contact with the water in the bowl of the toilet, the lower sheet extending directly beneath the plurality of slits in the upper sheet;

wherein the lower sheet of the sheet assembly comprises a top surface with a first surface area and the top surface of the upper sheet comprises a second surface area, wherein the second surface area is greater than the first surface area, wherein the plurality of slits in the upper sheet of the sheet assembly is configured to deflect any fluid waste disposed thereon within the bowl of the toilet to minimize the contaminated water in the bowl from exiting the toilet, wherein the sheet assembly in the bowl is configured to encapsulate the solid waste disposed on the upper sheet, thereby minimizing splashes of the contaminated water from exiting the bowl of the toilet, wherein the sheet assembly is configured to permit the fluid waste disposed on the plurality of slits in the upper sheet to pass therethrough and generate bubbles between the upper and lower sheets, thereby enhancing flotation of the sheet assembly on the water in the bowl of the toilet.

2. The splash guard apparatus of claim 1, wherein the upper and lower sheets of the sheet assembly are coupled together by an adhesive.

3. The splash guard apparatus of claim 2, wherein the adhesive is disposed along a perimeter extending around the plurality of slits in the upper sheet of the sheet assembly.

* * * * *